US008599103B2

(12) United States Patent
Fukuchi et al.

(10) Patent No.: US 8,599,103 B2
(45) Date of Patent: Dec. 3, 2013

(54) TERMINAL ARRANGEMENT STRUCTURE AND CARD-SHAPED DEVICE USING THE SAME

(75) Inventors: Hiroaki Fukuchi, Kyoto (JP); Yasutaka Maekawa, Kyoto (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 306 days.

(21) Appl. No.: 13/086,198

(22) Filed: Apr. 13, 2011

(65) Prior Publication Data

US 2011/0187626 A1 Aug. 4, 2011

Related U.S. Application Data

(63) Continuation of application No. PCT/JP2009/067786, filed on Oct. 14, 2009.

(30) Foreign Application Priority Data

Oct. 14, 2008 (JP) ..... 2008-265368

(51) Int. Cl.
*H01Q 1/00* (2006.01)

(52) U.S. Cl.
USPC ..... 343/906; 439/76.1; 439/82; 439/862; 439/884

(58) Field of Classification Search
USPC ..... 343/906; 439/76.1, 82, 862, 884
See application file for complete search history.

(56) References Cited

U.S. PATENT DOCUMENTS

| | | | | |
|---|---|---|---|---|
| 6,619,966 | B2 * | 9/2003 | Sakurada et al. | 439/76.1 |
| 2002/0001982 | A1 | 1/2002 | Sakurada et al. | |
| 2004/0244482 | A1 * | 12/2004 | Schultz | 73/335.01 |
| 2010/0003870 | A1 * | 1/2010 | Okuda et al. | 439/884 |

FOREIGN PATENT DOCUMENTS

| | | | |
|---|---|---|---|
| JP | 57-143581 | U | 9/1982 |
| JP | 09-199242 | A | 7/1994 |
| JP | 2001-332914 | A | 11/2001 |
| JP | 2002-518779 | A | 6/2002 |
| JP | 2003-22851 | A | 1/2003 |
| JP | 2003-297471 | A | 10/2003 |
| JP | 2004-335547 | A | 11/2004 |
| JP | 2004-335548 | A | 11/2004 |
| WO | 99/66500 | A1 | 12/1999 |

OTHER PUBLICATIONS

International Search Report; PCT/JP2009/067786; Nov. 24, 2009.

(Continued)

*Primary Examiner* — Allyson Trail
(74) *Attorney, Agent, or Firm* — Studebaker & Brackett PC

(57) ABSTRACT

The disclosure provides a terminal structure that includes an upper board and a lower board, which are adjacently provided and with respect to one another with a gap interposed therebetween. A conductor is formed on a rear surface side of upper board. A hole or a notch having an attached terminal is formed in lower board while penetrating through the lower board, and the terminal is electrically connected to the conductor on the upper board. The terminal includes a spring plate and a support section supporting the spring plate. The support section includes a fixing section that is fixed to lower board and a bottom plate that is positioned at a bottom surface side of lower board on a lower end side of the hole or notch. The spring plate of the terminal is formed to be connected to bottom plate and rise from bottom plate. The spring plate is extended upward from the lower end side of the hole or notch and comes into contact with conductor of upper board at an extended top position. Also provided is a card-shaped device including such a terminal structure.

11 Claims, 9 Drawing Sheets

(56) References Cited

OTHER PUBLICATIONS

Written Opinion of the International Searching Authority; PCT/JP2009/067786; Nov. 24, 2009.

Notice on the First Office Action issued by the State Intellectual Property Office of the People's Republic of China on Jun. 4, 2013, which corresponds to Chinese Patent Application No. 200980141634.6 and is related to U.S. Appl. No. 13/086,198 with translation.

* cited by examiner

TERMINAL ARRANGEMENT STRUCTURE AND CARD-SHAPED DEVICE USING THE SAME

CROSS REFERENCE TO RELATED APPLICATIONS

The present application is a continuation of International Application No. PCT/JP2009/067786, filed Oct. 14, 2009, which claims priority to Japanese Patent Application No. 2008-265368 filed Oct. 14, 2008, the entire contents of each of these applications being incorporated herein by reference in their entirety.

FIELD OF THE INVENTION

The invention relates to a terminal arrangement structure that electrically connects boards vertically disposed with a gap interposed therebetween and a card-shaped device using the terminal arrangement structure.

BACKGROUND

As illustrated in FIG. 7, a PC card is used while inserted and loaded on a personal computer 41. In wireless communication card terminals (card-type device) such as the PC card, there is proposed a card-type device in which a wireless communication antenna can be accommodated in and pulled out from a card body. For example, see Japanese Patent Laying-Open No. 2001-332914 (Patent Document 1).

FIGS. 8*a* and 8*b* illustrate an example of the PC card described in Patent Document 1. In a PC card 30, an antenna unit 22 equipped with the wireless communication antenna is provided so as to be slidable with respect to a card body 21. Note that FIG. 8*a* illustrates a state in which antenna unit 22 is pulled out from card body 21. FIG. 8*b* illustrates a state in which antenna unit 22 is accommodated in the card body 21.

In the proposed card-shaped device, as illustrated in FIGS. 9*a* and 9*b*, a connection structure in which a leaf spring 33 is used is adopted in order to electrically connect a board 32 of antenna unit 22 and a board 24 of card body 21. FIG. 9*a* is a view illustrating the connection structure between card body 21 and antenna unit 22 when viewed from above PC card 30. FIG. 9*b* is a view illustrating the connection structure between card body 21 and antenna unit 22 when viewed from below PC card 30. In the example of FIGS. 9*a* and 9*b*, corresponding leaf spring 33 is connected to each of a plurality of conductive pads 26 provided in board 32. Leaf spring 33 is electrically connected to a conductive pad 25 provided in board 24.

The following configuration has been proposed as a configuration in which different boards are electrically connected to each other. That is, a configuration in which a FPC (Flexible Printed Circuit) that is a flat flexible cable is used and a configuration in which the leaf spring is used are proposed. See, Japanese Patent Laying-Open No. 2004-335547 (Patent Document 2) and Japanese Patent Laying-Open No. 2004-335548 (Patent Document 3).

SUMMARY

In an embodiment of the disclosure, a terminal arrangement structure includes an upper board including a conductor on a surface thereof and a lower board provided adjacent the upper board with a gap interposed therebetween. The lower board includes a hole or a notch through the lower board and a terminal attached to the hole or notch. The terminal electrically connects to the conductor of the upper board and includes a spring plate and a support section supporting the spring plate. The support section includes a fixing section fixed to the lower board and a bottom plate positioned at a bottom surface side of the lower board on a lower end side of the hole or notch. The spring plate connects to the bottom plate to rise from the bottom plate and extends upward from the lower end side of the hole or notch and comes into contact with the conductor of the upper board at an extended top position.

In another embodiment of the disclosure, a card-shaped device includes a card body insertable into a card insertion unit and a slide antenna board insertable into a rear end side of the card body. The slide antenna board is slidably insertable in a card insertion direction of the card body and slidably movable between a state in which slide antenna board is accommodated in the card body and a state in which the slide antenna board is pulled out from the card body. The slide antenna board includes at least one planar type antenna, and a board on the card body side is adjacent the slide antenna board with a gap interposed therebetween. The card-shaped device may have a terminal arrangement structure as described above to electrically connect the slide antenna board and the board of the card body, where at least one of the slide antenna board and the board of the card body constitutes the upper board while the other constitutes the lower board.

In a more specific embodiment, a terminal structure may include extended plates that connect to respective sides of the spring plate in the bottom plate of the support section of the terminal, and each extended plate may fold from a connection portion between the extend plate and the bottom plate to rise and extend along an inner wall of the hole or notch of the lower board. Each extended plate may change an extended direction thereof in an upper end portion of the hole or notch and be provided along a surface side of the lower board toward a direction in which the extended plate is separated from the hole or notch, and may be fixed onto the surface side of the lower board.

In another more specific embodiment, the bottom plate of the support section of the terminal may overhang in at least one of a width direction and a length direction from the hole or the notch of the lower board, and the bottom plate of the support section may be provided along a rear surface side of the lower board. A region of the bottom plate of the support section may be provided on the rear surface side of the lower board and may be fixed onto the rear surface side of the lower board.

In another more specific embodiment, the spring plate of the terminal may be formed on one end side of the bottom plate of the support section in the hole or notch of the lower board. An extended plate may be provided on the one end side of the bottom plate or on another end side of the bottom plate, the extended plate may connect to the bottom plate, fold from a connection portion between the extended plate and the bottom plate to rise and extend along a surface side of the lower board. The extended plate may change an extended direction thereof in an upper end portion of the hole or notch, may be provided along a surface side of the lower board toward a direction in which the extended plate is separated from said hole or notch, and may be fixed onto the surface side of the lower board.

In another more specific aspect of the disclosure, the bottom plate may be provided so as to close a lower opening of the hole or notch of the lower board.

In yet another more specific aspect of the disclosure, a terminal arrangement structure can include a lower board that is adjacent to and slidable relative to, and electrically connected with an upper board.

Other features, elements, and characteristics consistent with this disclosure will become more apparent from the following detailed description of exemplary embodiments with reference to the attached drawings.

DETAILED DESCRIPTION

Figure 9A:
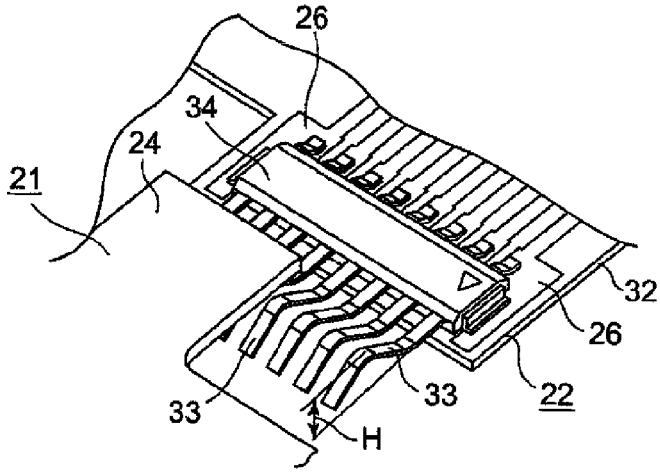
FIG.9a PRIOR ART
FIG. 9*a* is a view illustrating a connection structure of a board in the card-shaped device of FIGS. 8*a* and 8*b*.
Figure 9B:
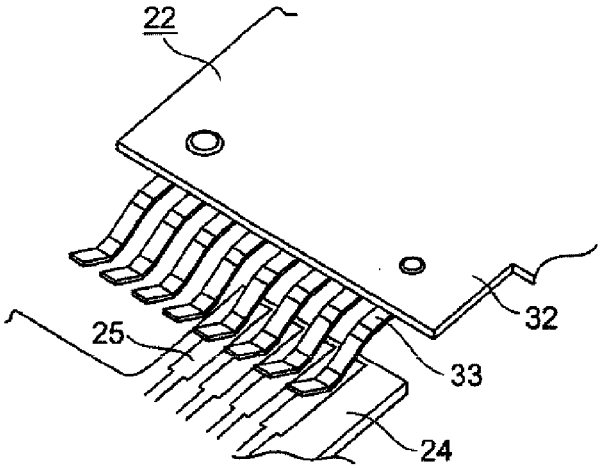
FIG.9b PRIOR ART
FIG. 9*b* is a view illustrating the connection structure of the board in the card-shaped device of FIGS. 8*a* and 8*b*.
Figure 10:
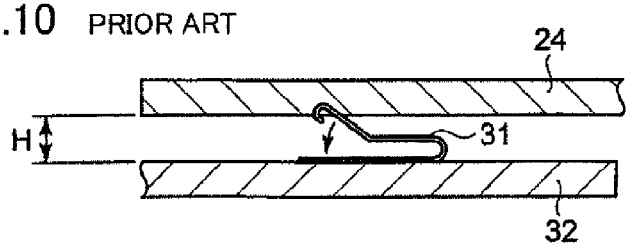
FIG.10 PRIOR ART
FIG. 10 is a side view illustrating a configuration example in which upper and lower boards are connected by a spring terminal.

The inventors have realized that in the configuration in which the boards are electrically connected to each other using leaf spring 33, it is necessary to form a gap between the boards by a height (see H of FIG. 9*a*) of leaf spring 33. FIG. 10 illustrates an example of a configuration in which boards 24 and 32 are connected using a spring terminal 31. However, it is also necessary to form widely the gap between boards 24 and 32. Accordingly, the connection structure in which leaf spring 33 or spring terminal 31 is used cannot meet a demand for a low profile of a connected product. Patent Document 2 describes a configuration in which the boards are electrically connected to each other using the FPC, but unfortunately the number of components and the number of production processes increase to raise the product cost.

Hereinafter, embodiments of the invention will be described with reference to the drawings.

Figure 1A:
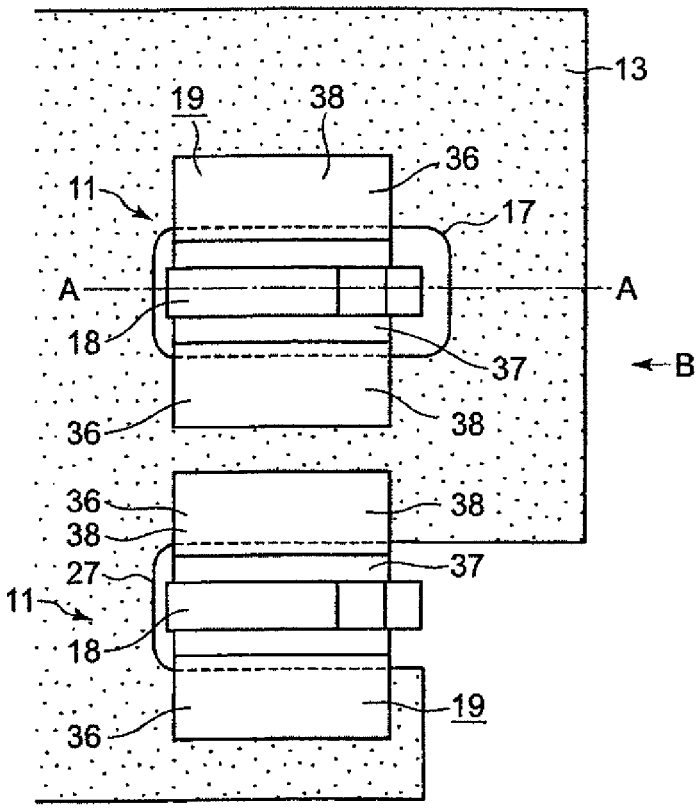
FIG. 1*a* is a plan view illustrating a terminal arrangement structure according to a first embodiment of the invention.
Figure 1B:
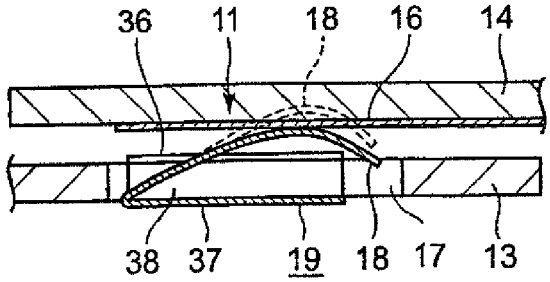
FIG. 1*b* is a sectional view taken on a line A-A of FIG. 1*a*.
Figure 1C:
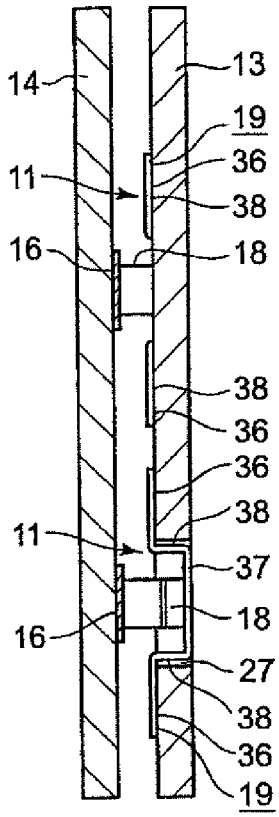
FIG. 1*c* is a side view of the terminal arrangement structure of FIG. 1*a* when viewed from a direction B.

FIGS. 1*a*, 1*b* and 1*c* schematically illustrate a terminal arrangement structure according to a first exemplary embodiment. FIG. 1*a* is a plan view illustrating a terminal 11 to which the terminal arrangement structure of the first exemplary embodiment is applied together with a lower board 13 to which terminal 11 is attached. In the terminal arrangement structure of the embodiment, lower board 13 is electrically connected to an upper board 14 by terminal 11, as illustrated in FIGS. 1*b* and 1*c*. In some embodiments, the lower board 13 can be slidably engaged with the upper board 14. FIG. 1*b* is a sectional view taken on a line A-A of FIG. 1*a* in the terminal arrangement structure of the first exemplary embodiment. FIG. 1*c* is a view illustrating the terminal arrangement structure of the first exemplary embodiment when viewed from a direction of an arrow B.

As illustrated in FIGS. 1*a*, 1*b* and 1*c*, for example, the upper board 14 and the lower board 13 are adjacent to each other with a gap therebetween. For example the boards 13 and 14 can be vertically disposed with a micro gap of 0.1 millimeter interposed therebetween. A conductor 16 is formed on a rear surface side of upper board 14. In order to attach terminal 11, a hole 17 or a notch 27 is formed in lower board 13 while penetrating through lower board 13. Terminal 11 is made of metal, such as phosphor bronze, and electrically connects to conductor 16 of upper board 14. Terminal 11 includes a spring plate 18 and a support section 19 that supports spring plate 18.

Support section 19 includes a fixing section 36 and a bottom plate 37. Fixing section 36 is fixed to lower board 13. On a lower end side of hole 17 or notch 27, bottom plate 37 is disposed on a bottom surface side of lower board 13. Bottom plate 37 is provided so as to close a lower opening (most part) of hole 17 or notch 27 of lower board 13. As used herein, the meaning of the lower opening of the hole or the notch being closed includes not only a mode in which the whole lower opening of the hole or the notch is essentially or completely closed, but also a mode in which the lower opening of the hole or the notch is partially closed.

In bottom plate 37, extended plates 38 are provided on both sides of spring plate 18. Extended plate 38 is connected to bottom plate 37, folded from connection portion between extended plate 18 and bottom plate 37 to rise and extend along an inner wall of hole 17 or notch 27 of lower board 13. Each extended plate 38 changes an extended direction in an upper end portion of hole 17 or notch 27. Extended plate 38 is provided along a surface side of lower board 13 toward a direction in which extended plate 38 is separated from hole 17 or notch 27. Extended plate 38 is fixed onto the surface side of lower board 13 using, for example, solder, to constitute fixing section 36.

In hole 17 or notch 27 of lower board 13, spring plate 18 of terminal 11 is connected onto one end side of bottom plate 37 of support section 19 to rise from bottom plate 37. Spring plate 18 is extended upward from a lower end side of hole 17 or notch 27, and spring plate 18 comes into contact with and is electrically connected to conductor 16 of upper board 14 at an extended top position In FIG. 1*b*, spring plate 18 illustrated by a broken line illustrates a state in which spring plate 18 is not pressed by upper board 14. It is to be appreciated that in any of the embodiments disclosed herein, the lower board 13 can make electrical contact with the upper board 14 in a slidingly engaged manner, where lower board 13 moves relative to the upper board 14.

A terminal arrangement structure according to a second exemplary embodiment will now be described. In the second exemplary embodiment, the components identical or similar to those of the first exemplary embodiment are designated by the identical numeral, and unless stated otherwise, the overlapping description is provided above or simplified.

Figure 2A:
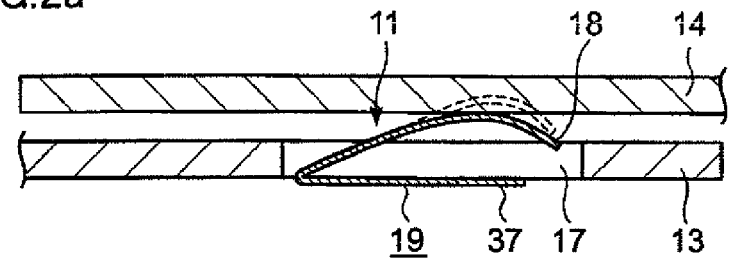
FIG. 2*a* is a sectional view illustrating a terminal arrangement structure according to a second embodiment of the invention.
Figure 2B:
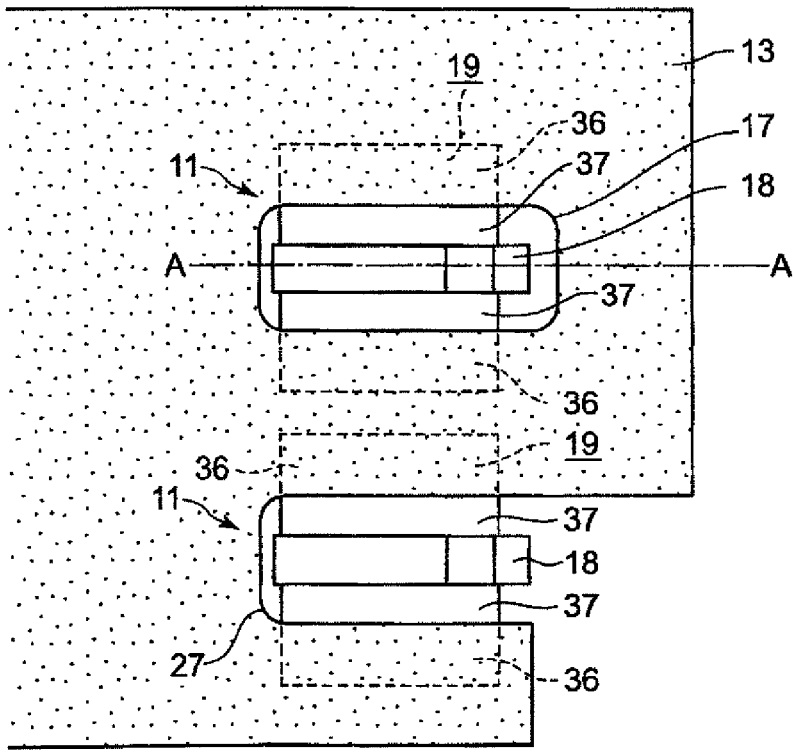
FIG. 2*b* is a plan view illustrating the terminal arrangement structure of the second embodiment of the invention.

FIGS. 2*a* and 2*b* schematically illustrate a terminal arrangement structure according to a second exemplary embodiment. FIG. 2*b* is a plan view illustrating terminal 11 together with lower board 13 to which terminal 11 is attached. FIG. 2*a* is a sectional view taken on a line A-A of FIG. 2*b* in the terminal arrangement structure of the second exemplary embodiment and additionally shows the upper board 14. In FIG. 2*a*, spring plate 18 is illustrated by a broken line and shows a state in which spring plate 18 is not pressed by upper board 14. A conductor is provided on the rear surface of the upper board 14 (not shown in FIG. 2*a*) can be implemented as conductor 16 shown in FIGS. 1*b* and 1*c*.

Similar to the first exemplary embodiment, in the second exemplary embodiment, upper board 14 and lower board 13 are electrically connected with terminal 11 interposed therebetween, and terminal 11 includes a spring plate 18 and a support section 19. However, as will be described below, the second exemplary embodiment differs from the first exemplary embodiment in a configuration of support section 19. That is, in the second exemplary embodiment, bottom plate 37 of support section 19 is formed while overhanging in a width direction from hole 17 or notch 27 of lower board 13, and bottom plate 37 is provided along the rear surface side of lower board 13. A region provided on the rear surface side of lower board 13 constitutes fixing section 36 and fixed onto the rear surface side of lower board 13 by solder or the like.

In a modification of the second exemplary embodiment, bottom plate 37 is formed while overhanging in a length direction or both the length direction and the width direction from hole 17 or notch 27 of lower board 13, and the overhung region constitutes fixing section 36.

A terminal arrangement structure according to a third exemplary embodiment will now be described. In the third exemplary embodiment, components similar or identical to that of the first and second exemplary embodiments are designated by the identical numeral, and unless described otherwise, the overlapping description is given above or simplified.

Figure 3A:
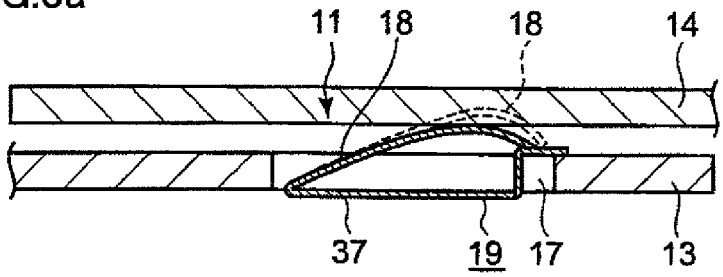
FIG. 3*a* is a sectional view illustrating a terminal arrangement structure according to a third embodiment of the invention.
Figure 3B:
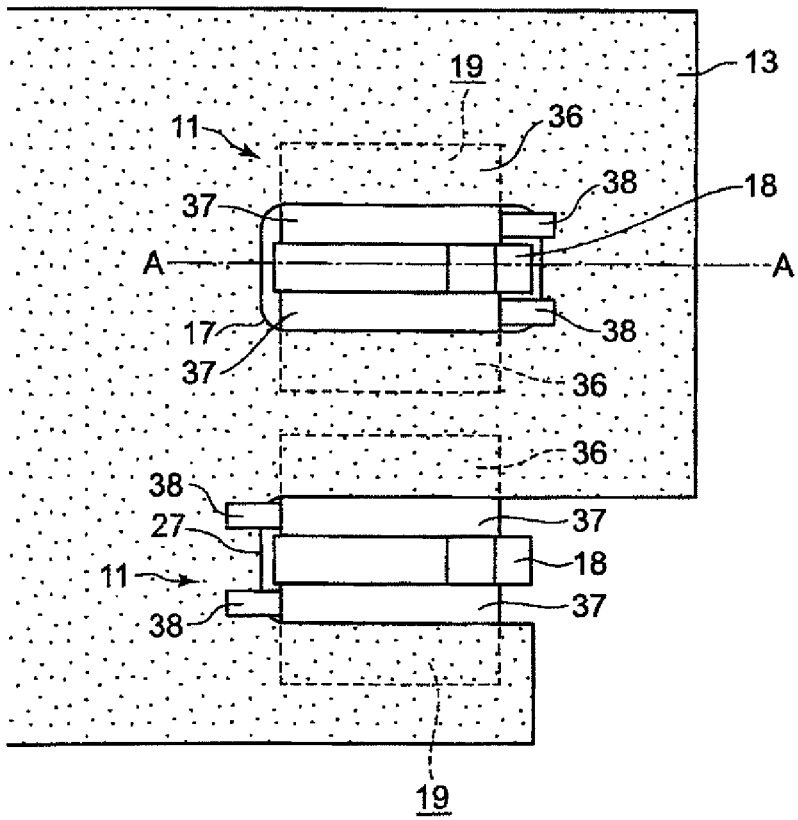
FIG. 3*b* is a plan view illustrating the terminal arrangement structure of the third embodiment of the invention.

FIG. 3*a* and FIG. 3*b* schematically illustrate a terminal arrangement structure according to a third exemplary embodiment. FIG. 3*b* is a plan view illustrating terminal 11 together with lower board 13 to which terminal 11 is attached. FIG. 3*a* is a sectional view taken on a line A-A of FIG. 3*b* in the terminal arrangement structure of the third embodiment and additionally shows the upper board 14. In FIG. 3*a*, spring plate 18 illustrated by a broken line shows a state in which spring plate 18 is not pressed by upper board 14. A conductor (not shown) is provided on the rear surface of the upper board 14, such as conductor 16 as shown in FIGS. 1*b* and 1*c*.

The third exemplary embodiment has the following configuration in addition to, or different from the configuration of the second exemplary embodiment. In bottom plate 37 of terminal 11, extended plate 38 is provided on one end side on which spring plate 18 is formed or the other end side of the bottom plate 37 where the spring plate is not formed. Extended plate 38 is connected to bottom plate 37, folds from the connection portion between extended plate 38 and bottom plate 37 to rise and extend along the inner wall of hole 17 or notch 27 of lower board 13. Extended plates 38 are formed on both sides of spring plate 18, and each extended plate 38 changes its extended direction in the upper end portion of hole 17 or notch 27. Extended plate 38 is provided along the surface side of lower board 13 toward the direction identical to the extended direction of spring plate 18 and the direction in which extended plate 38 is separated from hole 17 or notch 27. Extended plate 38 is arranged and can be fixed onto the surface side of lower board 13.

In the configuration of the third exemplary embodiment, when terminal 11 is provided in lower board 13, terminal 11 is fixed by the rear surface side and surface side of lower board 13. Terminal 11 is inserted in hole 17 or notch 27 from the rear surface side of lower board 13, and terminal 11 is disposed such that an extended leading end side (region provided along the surface side of lower board 13) of extended plate 38 is suspended on the surface side of lower board 13. Terminal 11 is fixed on the rear surface side of lower board 13 by solder or the like. The extended leading end side of extended plate 38 may be fixed by the solder or the like, although extended plate 38 may not be so fixed to the surface. The extended leading end side of extended plate 38 can be substantially fixed by fixing terminal 11 onto the rear surface side of lower board 13.

A fourth exemplary embodiment will now be described. The fourth exemplary embodiment is a card-shaped device in which a terminal arrangement structure according to any of the above embodiments is used. In the fourth exemplary embodiment, components similar or identical to that of the first and second exemplary embodiments are designated by the identical numeral, and unless described otherwise, the overlapping description is provided above or simplified.

Figure 4A:
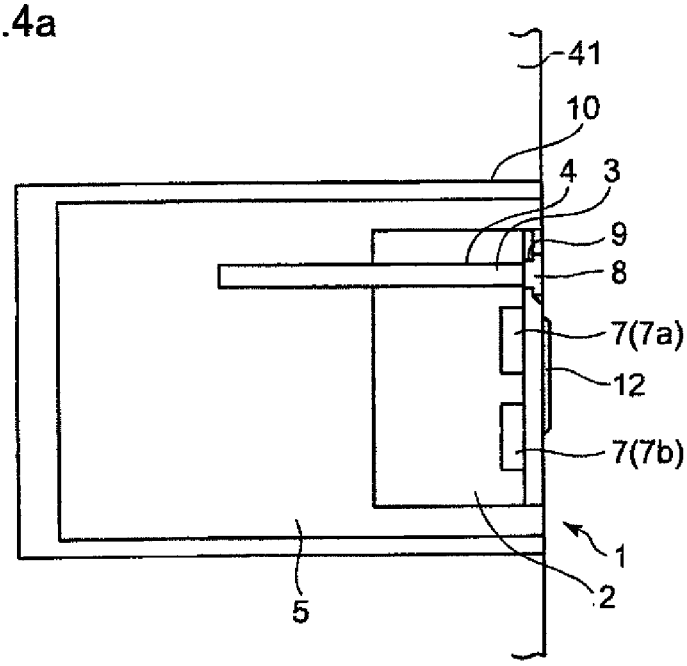
FIG. 4*a* is a sectional view illustrating a card-type device according to an embodiment of the invention.
Figure 4B:
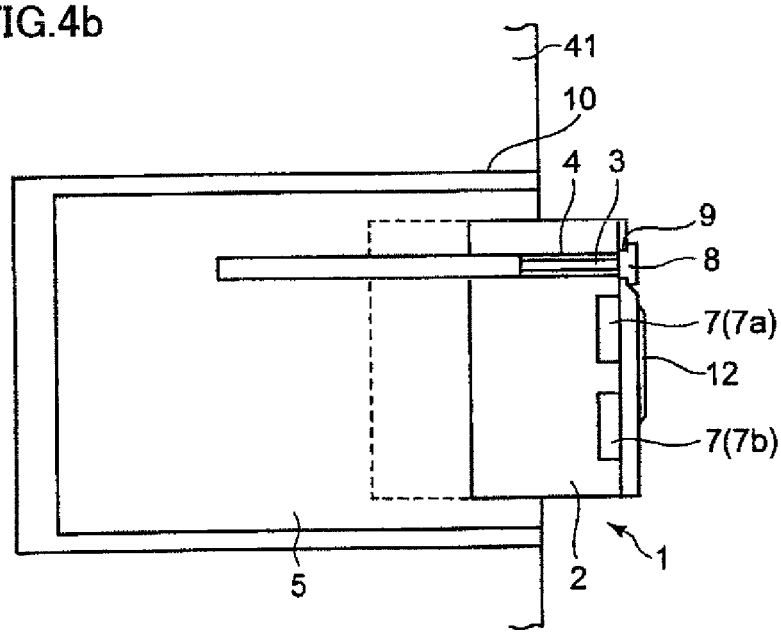
FIG. 4*b* is a sectional view illustrating a state in which a slide antenna board of the card-type device of the invention is pulled out.

FIGS. 4*a* and 4*b* are sectional views schematically illustrating a state in which a card-shaped device 1 of the fourth exemplary embodiment is inserted in and loaded on a card slot 10 of a personal computer 41 (for example, notebook personal computer). FIGS. 5*a* to 5*e* are appearance diagrams illustrating card-shaped device 1. As illustrated in FIGS. 5*a* to 5*e*, card device 1 of the fourth exemplary embodiment includes a card body 5 that is inserted in card slot 10 and a slide antenna board 2 that is accommodated in an insertion rear end side of card body 5. Slide antenna board 2 is slidably provided in a card insertion direction of card body 5. Slide antenna board 2 is slidably moved between a state in which slide antenna board 2 is accommodated in card body 5 and a state in which slide antenna board 2 is pulled out from card body 5.

Figure 5A:
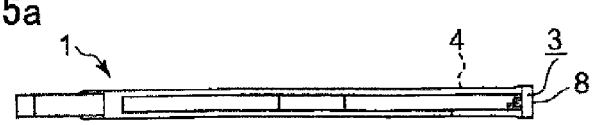
FIG. 5*a* is an appearance diagram illustrating the card-type device of the embodiment when viewed from a side direction.
Figure 5B:
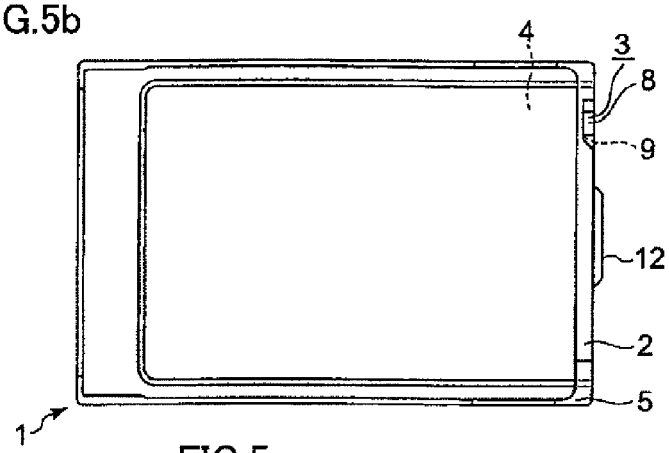
FIG. 5*b* is an appearance diagram illustrating the card-type device of the embodiment when viewed from an upper direction.
Figure 5C:
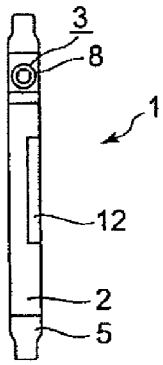
FIG. 5*c* is an appearance diagram illustrating the card-type device of the embodiment when viewed from a side on which the slide antenna board is provided.
Figure 5D:
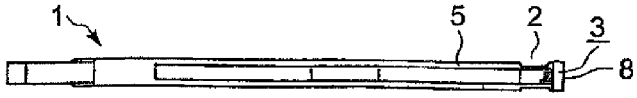
FIG. 5*d* is an appearance diagram illustrating a state in which the slide antenna board is pulled out in the card-type device of the embodiment when viewed from the side direction.
Figure 5E:
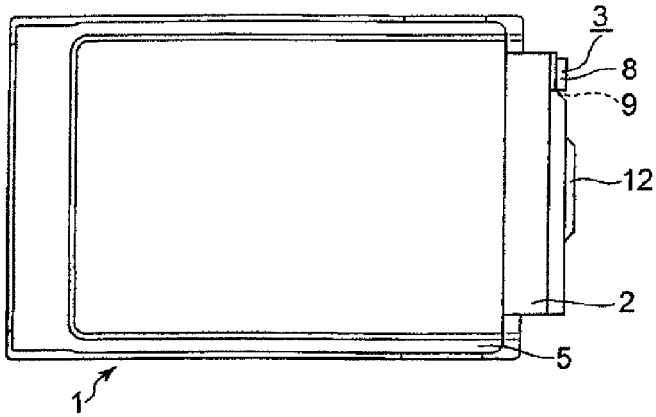
FIG. 5*e* is an appearance diagram illustrating a state in which the slide antenna board is pulled out in the card-type device of the embodiment when viewed from the upper direction.

FIG. 4*a* illustrates the state in which slide antenna board 2 is accommodated. FIG. 4*b* illustrates the state in which slide antenna board 2 is pulled out. FIGS. 5*a*, 5*b* and 5*c* illustrate the state in which slide antenna board 2 is accommodated. FIGS. 5*d* and 5*e* illustrate the state in which slide antenna board 2 is pulled out. FIGS. 5*b* and 5*e* are plan views of card-shaped device 1, and FIGS. 5*a* and 5*d* are side views of card-shaped device 1. FIG. 5*c* is a view illustrating card-shaped device 1 when viewed from a side on which slide antenna board 2 is provided.

As illustrated in FIGS. 4*a* and 4*b*, at least one wireless communication planar type antenna 7 is provided in slide antenna board 2. In the fourth embodiment, two wireless communication planar type antennae, 7*a* and 7*b*, are provided in the slide antenna board 2. In the embodiment, planar type antenna 7 is provided on a pull-out leading end side of slide antenna board 2. A slide guide 4 of a through-hole is provided in slide antenna board 2. A base end side of a wireless communication rod antenna 3 is fixed to card body 5. An extended side of rod antenna 3 from the base end side is slidably and stretchably disposed in a slide direction of slide antenna board 2 through slide guide 4.

Figure 6:
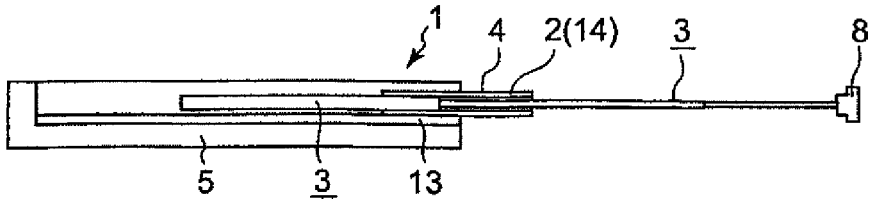
FIG. 6 is a schematic sectional view illustrating a stretching configuration of the rod antenna in the card-type device of the embodiment.
Figure 7:
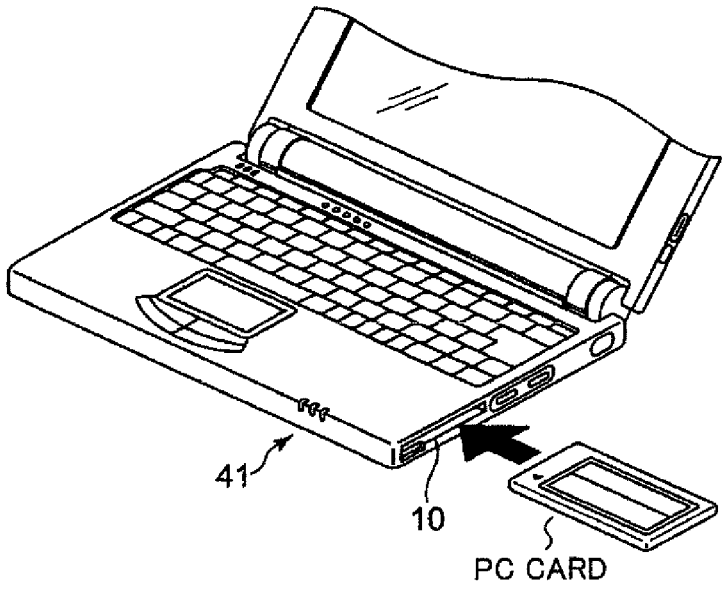
FIG.7 PRIOR ART
FIG. 7 is an explanatory view illustrating an operation to insert a PC card in a personal computer.
Figure 8A:
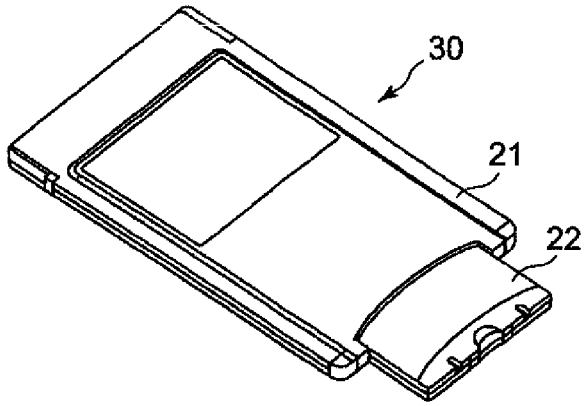
FIG.8a PRIOR ART
FIG. 8*a* is a perspective view illustrating an example of a conventional card-type device.
Figure 8B:
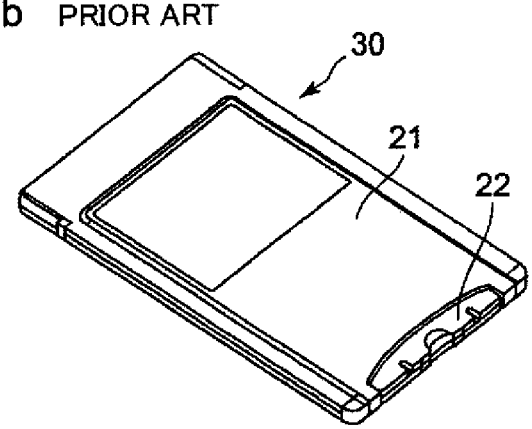
FIG.8b PRIOR ART
FIG. 8*b* is a view illustrating the example of the conventional card-type device.

As illustrated in FIG. 6, rod antenna 3 includes a multi-stage (in the embodiment, three-stage) rod unit so as to be able to be freely stretchable, or extendable. Therefore, as described above, rod antenna 3 is slidable and stretchable in the slide direction of slide antenna board 2. In rod antenna 3, when an antenna head 8 of rod antenna 3 is pulled out forward (by holding antenna head 8 between two fingers), antenna head 8 is extended to project a leading end side of the antenna head 8 ahead a leading end surface of the slide antenna board 2. On the other hand, when antenna head 8 of rod antenna 3 is pressed onto the side of slide antenna board 2, rod antenna 3 contracts to return to an original position. In FIG. 6, the numeral 13 designates a lower board provided in card body 5. Lower board 13 is provided with a micro gap interposed between lower board 13 and slide antenna board 2, and is electrically connected to rod antenna 3 and planar type antenna 7.

Rod antenna 3 is provided in a retreat position in which antenna leading end surface (end portion of antenna head 8) of rod antenna 3 is not projected from the leading end surface of slide antenna board 2 in the accommodation state of rod antenna 3. When a projection 12 provided on a pull-out leading end side of slide antenna board 2 is grasped to pull out slide antenna board 2 from card body 5, the leading end side of rod antenna 3 is pulled out from card slot 10 together with slide antenna board 2.

In card-shaped device 1 of the fourth exemplary embodiment, the board provided on the side of card body 5 and slide antenna board 2 are adjacently provided, for example, vertically disposed with a micro gap interposed therebetween. In one of the features of the fourth exemplary embodiment, terminal 11 that is provided in the board (lower board 13) of card body 5 while having the terminal arrangement structure of one of the first to third exemplary embodiments is connected to conductor 16 of planar antenna 7 provided in slide antenna board 2 (upper board 14).

The upper and lower boards cannot be rigidly connected by the connector and the like in the configuration such as the card-shaped device of the fourth exemplary embodiment in which at least one of upper board 14 and lower board 13 vertically disposed with the gap interposed therebetween is slidably movable relative to the other. However, the upper and lower boards can electrically be connected as appropriate by applying the terminal arrangement structures of the first to third embodiments. The gap between the upper and lower boards can be decreased by applying the terminal arrangement structures of the first to third exemplary embodiments, so that thinning (low profile) of card-shaped device 1 can be achieved.

The invention is not limited to the embodiments, but various modifications and changes can be made. For example, in card-shaped device 1 of the fourth exemplary embodiment, there is no particular restriction to various configurations except the connection structure between the board of card body 5 and slide antenna board 2, and the configurations are set as appropriate. In the fourth exemplary embodiment, the board of card body 5 constitutes lower board 13 while slide antenna board 2 constitutes upper board 14. Alternatively, the board of card body 5 may constitute upper board 14 while slide antenna board 2 constitutes lower board 13. In this case, terminal 11 is disposed on the side of slide antenna board 2.

The terminal arrangement structures of the embodiments are not limited to card-shaped device 1 of the fourth exemplary embodiment, but the terminal arrangement structures can widely be applied to the configurations in which upper and lower boards disposed with the gap (micro gap) interposed therebetween are electrically connected to each other.

In the terminal arrangement structures of the first to third exemplary embodiments, bottom plate 37 constituting support section 19 of terminal 11 is provided so as to close hole 17 or notch 27 of lower board 13. However, bottom plate 37 is not always provided so as to close hole 17 or notch 27. For example, bottom plate 37 can be provided along the rear surface side of lower board 13, one end side of bottom plate 37 can be provided on one end side of hole 17 or notch 27, and spring plate 18 can be formed so as to rise while connected to the region where one end side of bottom plate 37 is provided. At this point, bottom plate 37 is fixed onto rear surface side of lower board 13 so as to also act as fixing section 36.

The terminal arrangement structure of the embodiment having the configuration in which the upper and lower boards disposed with the gap (e.g., micro gap) interposed therebetween are electrically connected to each other can be applied to the card device and the like. The card-shaped device of the invention can be applied to the card-shaped device, such as the PC card and CF card, which is inserted in the personal computer and the like.

Embodiments of a terminal structure consistent with the disclosure facilitate lowering a terminal attaching level compared with the case in which the terminal is attached onto the surface side of the lower board because the terminal is attached to the hole or the notch.

As described above, the spring plate of the terminal can be extended and electrically connected to the upper board side from the bottom surface side of the lower board by utilizing a thickness of the lower board. Accordingly, the upper and lower boards can be connected to each other with the small gap to achieve the low profile of the product.

In embodiments consistent with the disclosure, unlike the connection in which the FPC is used, the upper and lower boards can electrically be connected with the terminal including the spring plate and the support section for the spring plate interposed therebetween. Accordingly, the number of components and the number of production processes do not increase. Additionally, the production can easily be performed while the terminal is fixed to the hole or the notch of the lower board, and the electric connection can easily be performed between the upper board and the lower board.

The following effect can be obtained when the upper and lower boards in which the upper board is slidably moved with respect to the lower board, such as the card device of the disclosure. The conductor formed on the upper board can be formed so as to have an appropriate length in the slidably moving direction that allows the lower board and the upper board to be electrically connected in the whole or partially appropriate range of the slidably moving range.

In a terminal arrangement structure according to an exemplary embodiment, extended plates are provided on both sides of the spring plate in the bottom plate of the support section of the terminal, and an extended leading end side of the extended plate is disposed along and fixed to the surface of the lower board. According to the configuration, the downward force acting on the terminal from the upper board by bringing the spring plate into contact with the upper board becomes the force pressing the terminal against the lower board to act in a direction in which the force fixing the terminal to the lower board increases. Therefore, the pressing force acts in the direction in which the terminal is pressed against the lower board by the connection between the terminal and the upper board, so that the terminal can better be fixed to the lower board.

According to an exemplary configuration, a terminal can be disposed in the hole or notch from the surface side of the lower board. Therefore, the terminal can automatically be provided (mounted) on the lower board of the terminal to produce the product at lower cost.

In a terminal arrangement structure according to an exemplary embodiment, the bottom plate of the support section of the terminal can be formed while overhanging in at least one of a width direction and a length direction from the hole or the notch of the lower board, and the bottom plate of the support section can be provided along a rear surface side of the lower board. Also, a region provided on the rear surface side of the lower board can be fixed onto the rear surface side of the lower board. Accordingly, a configuration of the terminal can be simplified.

In a terminal arrangement structure of still another exemplary embodiment, a support section of the terminal can have a configuration in which a region provided on a rear surface side of the lower board is fixed. Additionally, the spring plate of the terminal can be formed on one end side of the bottom plate of the support section in the hole or the notch of the lower board, an extended plate can be provided on the one end side of the bottom plate or the another end side of the extended plate, the extended plate can be connected to the bottom plate, fold from a connection portion between the extended plate and the bottom plate to rise, and extend along a surface side of the lower board. Therefore, the terminal can be fixed to both the rear surface side and the surface side of the lower board. Accordingly, the extended leading end side of the extended plate can be fixed to the surface side of the lower board, even if a downward force acting on the terminal from the upper board by bringing the spring plate into contact with the upper board becomes a force pressing the terminal against the lower board to act in a direction in which the force repels a fixing force from the rear surface side of the lower board of the terminal. Consequently, the terminal can better be fixed to the lower board.

In another exemplary terminal arrangement structure, a bottom plate can be provided so as to substantially close a lower opening of the hole or the notch of the lower board. As a result, the terminal can more simply and securely be attached to the hole or the notch of the lower board.

In an embodiment of a card-shaped device described herein having any of the above-described terminal arrangement structures, the terminal provided on the board of the card body can easily and properly be connected to the conductor of the planar antenna provided in the slide antenna board. Because such a card-shaped device has a terminal arrangement structure as described above, the card-shaped device can easily be produced to achieve the low profile and the cost reduction.

It should be understood that the above-described embodiments are illustrative only and that variations and modifications will be apparent to those skilled in the art without departing from the scope and spirit of the disclosure. The scope of the present invention should be determined in view of the appended claims and their equivalents.

The invention claimed is:

1. A terminal arrangement structure, comprising:

an upper board including a conductor on a surface thereof; and a lower board provided adjacent the upper board with a gap interposed therebetween, wherein the lower board includes a hole or a notch through the lower board and a terminal is attached to the hole or notch, the terminal is electrically connected to the conductor of the upper board and includes a spring plate and a support section supporting the spring plate, the support section includes a fixing section fixed to the lower board and a bottom plate positioned at a bottom surface side of the lower board on a lower end side of the hole or notch, the spring plate is connected to the bottom plate to rise from the bottom plate, the spring plate extends upward from the lower end side of the hole or notch and comes into contact with the conductor of the upper board at an extended top position, extended plates connect to respective sides of the spring plate in the bottom plate of the support section of the terminal, and each extended plate folds from a connection portion between the extended plate and the bottom plate to rise and extend along an inner wall of the hole or the notch of the lower board, and each extended plate changes an extended direction thereof in an upper end portion of the hole or notch and is provided along a surface side of the lower board toward a direction in which the extended plate is separated from the hole or notch, and is fixed onto the surface side of the lower board.

2. A terminal arrangement structure, comprising:

an upper board including a conductor on a surface thereof; and a lower board provided adjacent the upper board with a gap interposed therebetween, wherein the lower board includes a hole or a notch through the lower board and a terminal is attached to the hole or notch, the terminal is electrically connected to the conductor of the upper board and includes a spring plate and a support section supporting the spring plate, the support section includes a fixing section fixed to the lower board and a bottom plate positioned at a bottom surface side of the lower board on a lower end side of the hole or notch, the spring plate is connected to the bottom plate to rise from the bottom plate, the spring plate extends upward from the lower end side of the hole or notch and comes into contact with the conductor of the upper board at an extended top position, wherein the bottom plate of the support section of the terminal overhangs in at least one of a width direction and a length direction from the hole or the notch of the lower board, the bottom plate of the support section is provided along a rear surface side of the lower board, and a region of the bottom plate of the support section provided along the rear surface side of the lower board is fixed onto the rear surface side of the lower board.

3. The terminal arrangement structure according to claim 2, wherein the spring plate is connected onto one end side of the bottom plate of the support section in the hole or notch of the lower board, an extended plate is provided on one of the one end side of the bottom plate or another end side of the bottom plate, the extended plate connected to the bottom plate and folded from a connection portion between the extended plate and the bottom plate to rise and extend along an inner wall of the hole or notch of the lower board, and the extended plate changes an extended direction thereof in an upper end portion of the hole or notch, is provided along a surface side of the lower board toward a direction in which the extended plate is separated from the hole or notch, and is fixed onto the surface side of the lower board.

4. The terminal arrangement structure according to claim 1, wherein the bottom plate substantially closes a lower opening of the hole or the notch of the lower board.

5. The terminal arrangement structure according to claim 2, wherein the bottom plate substantially closes a lower opening of the hole or the notch of the lower board.

6. The terminal arrangement structure according to claim 3, wherein the bottom plate substantially closes a lower opening of the hole or the notch of the lower board.

7. A terminal arrangement structure, comprising:

an upper board including a conductor on a surface thereof; and a lower board provided adjacent the upper board with a gap interposed therebetween, wherein the lower board includes a hole or a notch through the lower board and a terminal is attached to the hole or notch, the terminal is electrically connected to the conductor of the upper board and includes a spring plate and a support section supporting the spring plate, the support section includes a fixing section fixed to the lower board and a bottom plate positioned at a bottom surface side of the lower board on a lower end side of the hole or notch, the spring plate is connected to the bottom plate to rise from the bottom plate, the spring plate extends upward from the lower end side of the hole or notch and comes into contact with the conductor of the upper board at an extended top position, and the lower board is slidable relative to, and electrically connected with the upper board.

8. A card-shaped device comprising:

a card body insertable into a card insertion unit; and a slide antenna board insertable into a rear end side of the card body, wherein the slide antenna board is slidably insertable in a card insertion direction of the card body and slidably movable between a state in which slide antenna board is accommodated in the card body and a state in which the slide antenna board is pulled out from the card body, at least one planar type antenna is in the slide antenna board, a board on the card body side is adjacent the slide antenna board with a gap interposed therebetween, and the card-shaped device has a terminal arrangement structure comprising:

an upper board including a conductor on a surface thereof; and a lower board provided adjacent the upper board with a gap interposed therebetween, wherein the lower board includes a hole or a notch through the lower board and a terminal is attached to the hole or notch, the terminal is electrically connected to the conductor of the upper board and includes a spring plate and a support section supporting the spring plate, the support section includes a fixing section fixed to the lower board and a bottom plate positioned at a bottom surface side of the lower board on a lower end side of the hole or notch, the spring plate is connected to the bottom plate to rise from the bottom plate, and the spring plate extends upward from the lower end side of the hole or notch and comes into contact with the conductor of the upper board at an extended top position, said terminal arrangement structure configured to electrically connect the slide antenna board and the board of the card body, and at least one of the slide antenna board and the board of the card body constitutes the upper board while the other constitutes the lower board.

9. A card-shaped device comprising:

a card body insertable into a card insertion unit; and a slide antenna board insertable into a rear end side of the card body, wherein the slide antenna board is slidably insertable in a card insertion direction of the card body and slidably movable between a state in which slide antenna board is accommodated in the card body and a state in which the slide antenna board is pulled out from the card body, at least one planar type antenna is in the slide antenna board, a board on the card body side is adjacent the slide antenna board with a gap interposed therebetween, and the card-shaped device has a terminal arrangement structure as in claim 2 to electrically connect the slide antenna board and the board of the card body, and at least one of the slide antenna board and the board of the card body constitutes the upper board while the other constitutes the lower board.

10. A card-shaped device comprising:

a card body insertable into a card insertion unit; and a slide antenna board insertable into a rear end side of the card body, wherein the slide antenna board is slidably insertable in a card insertion direction of the card body and slidably movable between a state in which slide antenna board is accommodated in the card body and a state in which the slide antenna board is pulled out from the card body, at least one planar type antenna is in the slide antenna board, a board on the card body side is adjacent the slide antenna board with a gap interposed therebetween, and the card-shaped device has a terminal arrangement structure as in claim 3 to electrically connect the slide antenna board and the board of the card body, and at least one of the slide antenna board and the board of the card body constitutes the upper board while the other constitutes the lower board.

11. A card-shaped device comprising:

a card body insertable into a card insertion unit; and a slide antenna board insertable into a rear end side of the card body, wherein the slide antenna board is slidably insertable in a card insertion direction of the card body and slidably movable between a state in which slide antenna board is accommodated in the card body and a state in which the slide antenna board is pulled out from the card body, at least one planar type antenna is in the slide antenna board, a board on the card body side is adjacent the slide antenna board with a gap interposed therebetween, and the card-shaped device has a terminal arrangement structure as in claim 4 to electrically connect the slide antenna board and the board of the card body, and at least one of the slide antenna board and the board of the card body constitutes the upper board while the other constitutes the lower board.

* * * * *

UNITED STATES PATENT AND TRADEMARK OFFICE

CERTIFICATE OF CORRECTION

PATENT NO. : 8,599,103 B2
APPLICATION NO. : 13/086198
DATED : December 3, 2013
INVENTOR(S) : Hiroaki Fukuchi and Yasutaka Maekawa It is certified that error appears in the above-identified patent and that said Letters Patent is hereby corrected as shown below:

Title Page (73) ASSIGNEE should read:

MURATA MANUFACTURING CO., LTD., KYOTO-FU, JAPAN

SII MOBILE COMMUNICATIONS INC., CHIBA, JAPAN

Signed and Sealed this
Thirty-first Day of December, 2013

Margaret A. Focarino

Margaret A. Focarino
*Commissioner for Patents of the United States Patent and Trademark Office*